US011053961B2

(12) United States Patent
Marshall

(10) Patent No.: US 11,053,961 B2
(45) Date of Patent: Jul. 6, 2021

(54) PISTON CONTROL VIA ADJUSTABLE ROD

(71) Applicant: Novatek IP, LLC, Provo, UT (US)

(72) Inventor: Jonathan D. Marshall, Mapleton, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 90 days.

(21) Appl. No.: 16/217,019

(22) Filed: Dec. 11, 2018

(65) Prior Publication Data

US 2020/0182271 A1 Jun. 11, 2020

(51) Int. Cl.
*F15B 15/22* (2006.01)
*F15B 15/14* (2006.01)

(52) U.S. Cl.
CPC ..... *F15B 15/223* (2013.01); *F15B 15/1428* (2013.01); *F15B 15/1452* (2013.01); *F15B 15/1457* (2013.01); *F15B 2215/30* (2013.01)

(58) Field of Classification Search
CPC .... F15B 15/222; F15B 15/24; F15B 15/2807; F15B 15/2892; F15B 15/28; F15B 15/223; F15B 2015/267; F15B 15/261
See application file for complete search history.

(56) References Cited

U.S. PATENT DOCUMENTS

| | | | | |
|---|---|---|---|---|
| 1,909,372 | A | 5/1933 | McCollum et al. | |
| 1,912,604 | A | 6/1933 | Valentine | |
| 5,163,386 | A | 11/1992 | Schechter | |
| 7,409,901 | B2 | 8/2008 | Lucas et al. | |
| 9,085,941 | B2 | 7/2015 | Hall et al. | |
| 9,822,777 | B2 | 11/2017 | Adeleye | |
| 10,077,104 | B2 * | 9/2018 | Ataman | B64C 25/28 |
| 10,125,679 | B2 | 11/2018 | Zahdeh | |

FOREIGN PATENT DOCUMENTS

WO WO-2007057927 A1 * 5/2007 ..... F16K 31/1635

* cited by examiner

*Primary Examiner* — Abiy Teka

(57) ABSTRACT

A piston's stroke length may be restricted by passing a rod through a through hole in the piston. The stroke length's boundaries may be defined by the points where an interior of the through hole contacts an exterior of the rod. Adjusting a position or orientation of the rod may alter this stroke length. If the rod comprises a noncylindrical external geometry, a radius thereof may vary along an axial length of the rod or around a circumference thereof. Adjustment of the rod, via axial translation or rotation for example, may change the position of contact between the rod and the through hole. Alternately, the through hole may comprise a unique geometry in which the rod may radially translate to adjust the piston's stroke length.

20 Claims, 4 Drawing Sheets

PISTON CONTROL VIA ADJUSTABLE ROD

BACKGROUND

A piston may slide within a hollow cylinder to alter a contained volume therein. Such a piston-cylinder combination may form a type of transducer capable of converting energy between fluid pressure and mechanical motion. For example, in an engine, energy in the form of expanding gas enclosed within a cylinder may be transferred to a piston causing it to slide. In a pump, this function may be reversed with force from the piston compressing fluid within the cylinder.

In some instances, it may be desirable to define a maximum distance, known as a "stroke length," that a piston can travel within a cylinder. This may be done in a variety of ways. For example, U.S. Pat. No. 9,085,941 to Hall, et al. describes a pin that may be inserted into a passageway in a piston. While the piston is translating, the passageway may come into contact with the pin to inhibit further translational movement of the piston. The pin may be configured to allow the piston to translate a specified distance.

Other devices may not only define a stroke length for a piston but also allow for adjustment of that stroke length. U.S. Pat. No. 7,409,901 to Lucas, et al. describes how a piston stroke length may be adjusted manually via various mechanical means, such as, for example, by adjusting the throw of an eccentric lobe that rotates to drive the piston, or by adjusting swivels, cams, or linkages. While such means may achieve their intended functions, adjusting a piston's stroke length by simpler processes may prove valuable.

BRIEF DESCRIPTION

A piston's stroke length may be defined by a rod passing through a through hole in the piston, restricting the piston's motion, and altered by adjusting the rod. In some embodiments, this rod may comprise a noncylindrical external geometry that may interact with an interior of the piston's through hole. A radius of this noncylindrical external geometry may vary along an axial length of the rod or around a circumference thereof. Adjustment of the rod, via axial translation or rotation for example, may change a point of contact between the rod's external geometry and the through hole's interior and adjust possible stroke lengths. Alternately, the through hole may comprise a unique geometry in which the rod may radially translate to adjust the piston's stroke length.

DRAWINGS

FIGS. 2-1 and 2-2 are sectional views of embodiments of pistons comprising adjustable rods passing therethrough capable of altering stroke restrictions of each piston. FIG. 2-3 is a perspective view of an embodiment of a rod of the type shown in FIGS. 2-1 and 2-2.

FIGS. 3-1 and 3-2 are sectional views of additional embodiments of pistons comprising adjustable rods passing therethrough. FIG. 3-3 is a perspective view of an embodiment of a rod of the type shown in FIGS. 3-1 and 3-2.

DETAILED DESCRIPTION

Figure 1:
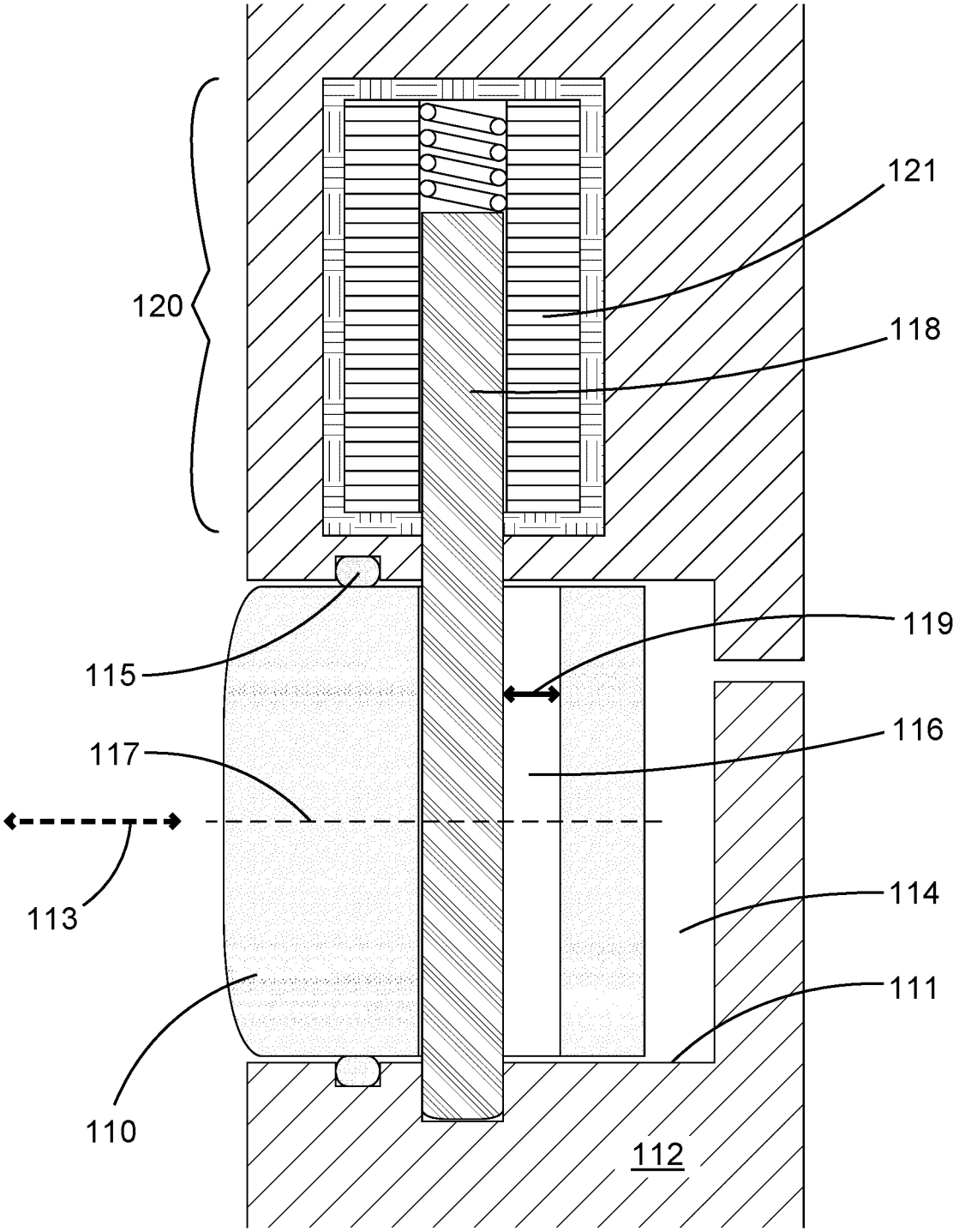
FIG. 1 is a sectional view of an embodiment of a piston slidably disposed within a hollow cylinder and a rod passing through a through hole in the piston, restricting a stroke thereof.

Referring now to the figures, FIG. 1 shows an embodiment of piston 110 slidably disposed within a hollow cylinder 111 formed in a mass 112. An arrow shows a direction 113 of possible travel for this piston 110 that may be aligned with a central axis 117 of the piston 110. The piston 110 and cylinder 111 may combine to form a volume 114 capable of containing a fluid. A gasket 115 may surround the piston 110 and keep fluid contained within the volume 114 from escaping between the piston 110 and cylinder 111. An increase in fluid pressure within the volume 114 may urge the piston 110 to slide out of the cylinder 111. Conversely, a decrease in fluid pressure may pull the piston 110 back into the cylinder 111.

The piston 110 may comprise a through hole 116 passing therethrough. In the embodiment shown, the through hole 116 passes radially across the piston 110, perpendicular to and touching the central axis 117 of the piston 110; although other arrangements are also possible.

A rod 118 may span the hollow cylinder 111 from one side to another; secured to internal walls of the cylinder 111 at opposing ends thereof. This rod 118 may also be positioned perpendicular to the central axis 117 of the piston 110, similarly to the through hole 116, and extend through the through hole 116. By extending through the through hole 116 and attaching to opposing sides of the cylinder 111, the rod 118 may restrict axial motion of the piston 110.

Internal dimensions of the through hole 116 may be larger than external dimensions of the rod 118, allowing the piston 110 to translate a certain distance before restriction by the rod 118. A distance that the piston 110 may travel before contacting the rod 118 may define a stroke length 119 for the piston 110. Further, a cross section of the through hole 116 may comprise a generally oblong shape that is elongated in the direction 113 of travel of the piston 110.

A solenoid 120, or other type of control device in alternate embodiments, may adjust a position of this rod 118 and this adjustment may alter the defined stroke length 119. Such adjustments may provide additional benefits such as distributing impact wear between the rod 118 and the through hole 116. This solenoid 120 may comprise at least one electrically conductive wire 121 wound in a coil. If an electrical current is passed through such a wire 121 a magnetic field may be produced that may act on certain materials forming the rod 118. Examples of other types of control devices capable of adjusting a position of a rod, that may replace the solenoid in other embodiments, include a hydraulic pump and ball screw. It is believed that such alternate control devices may provide additional accuracy at an expense of additional complexity.

Figures 1, 2:
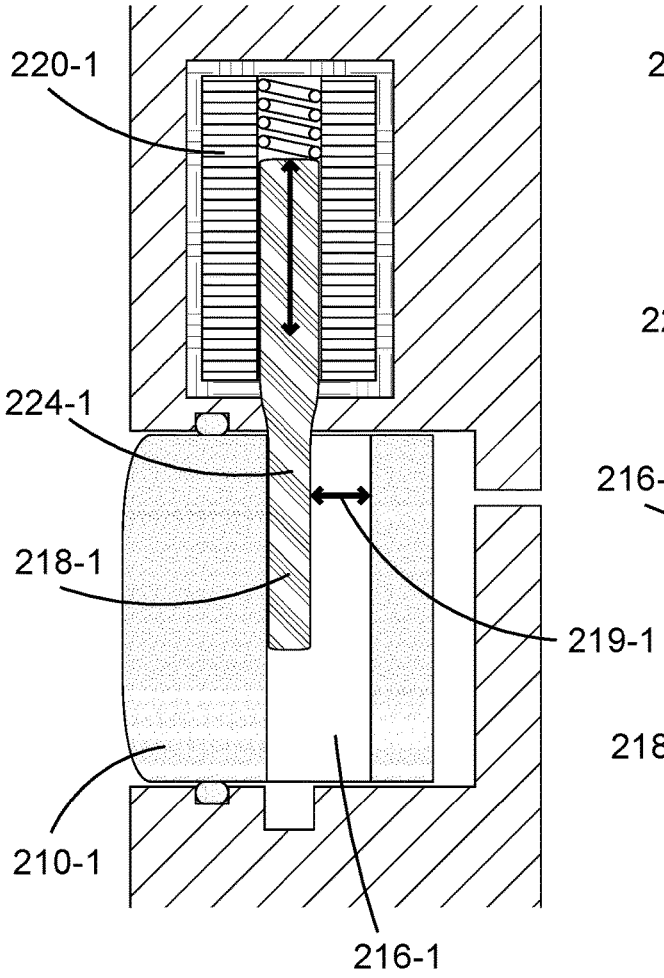
Figure 2:
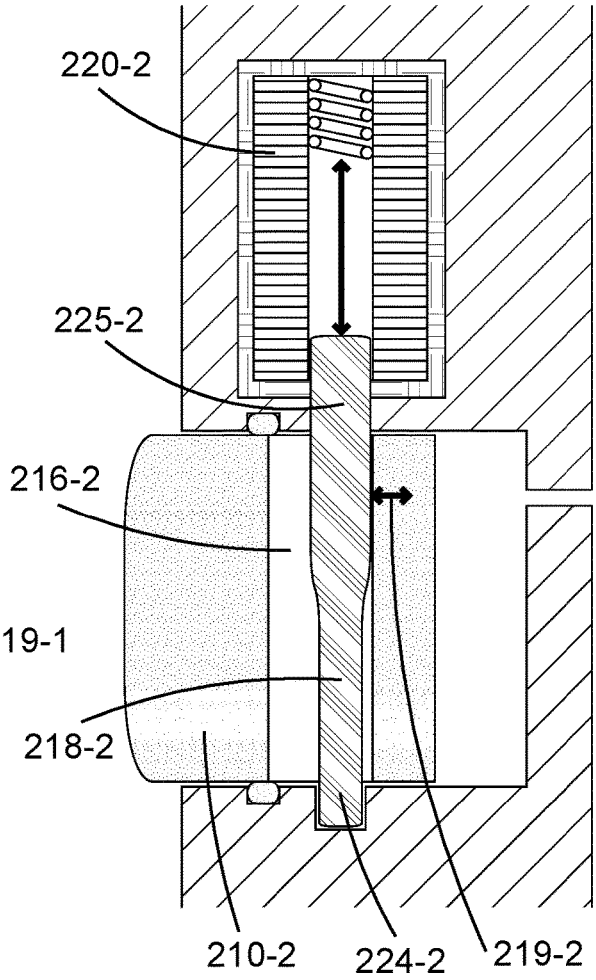

FIGS. 2-1 and 2-2 show embodiments of adjustable rods 218-1, 218-2 that may alter respective stroke lengths 219-1, 219-2 of associated pistons 210-1, 210-2. These alterations may be enabled by unique geometries possessed by the rods 218-1, 218-2. Specifically, such rods 218-1, 218-2 may each comprise a noncylindrical external geometry that may encounter an interior of a through hole 216-1, 216-2 of its associated piston 210-1, 210-2 at different points based on the rods' 218-1, 218-2 positioning.

Figures 2, 3:
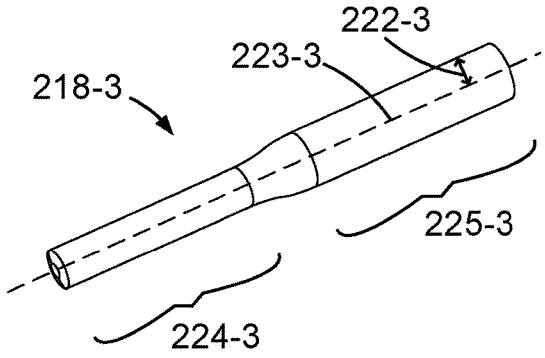
Figures 1, 3:
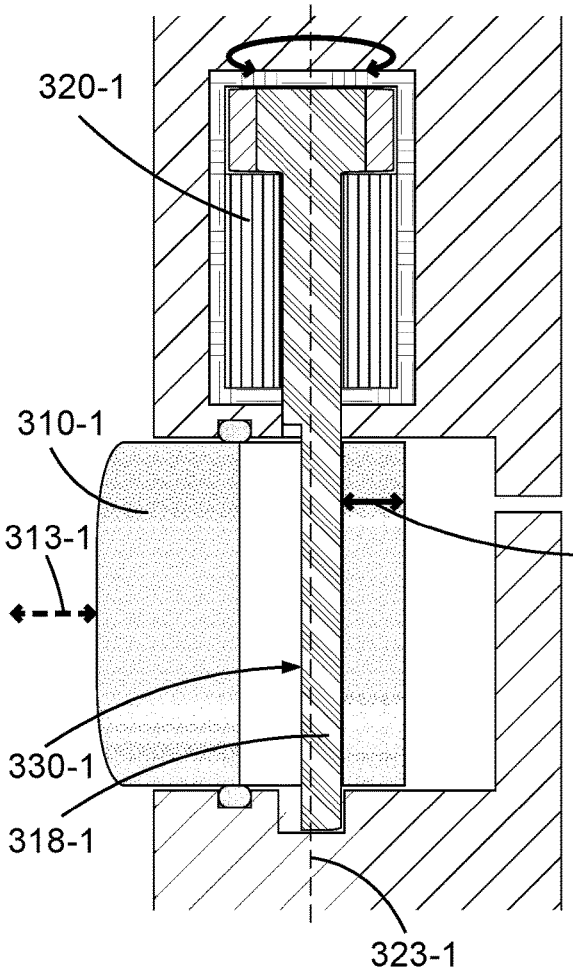
Figures 2, 3:
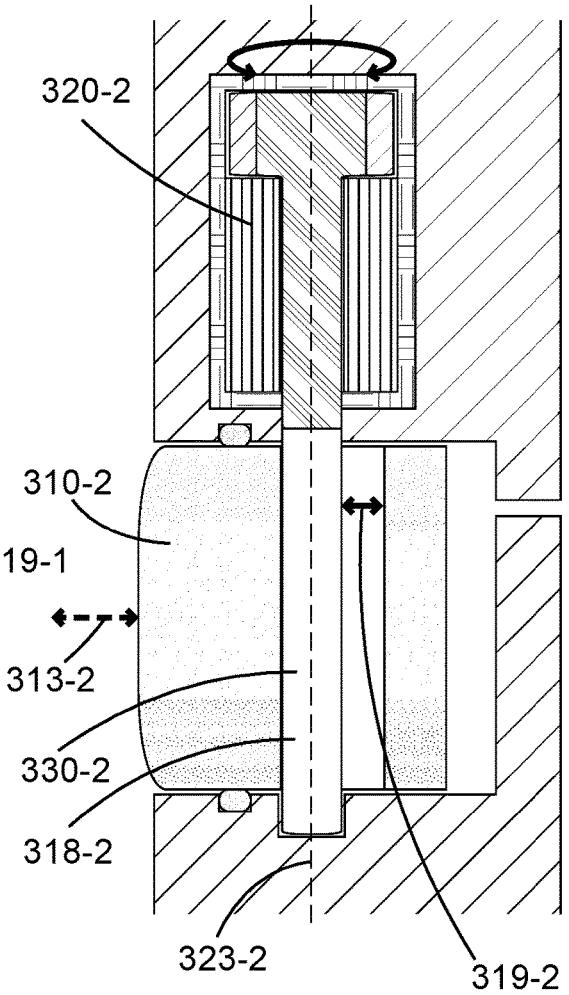
Figure 3:
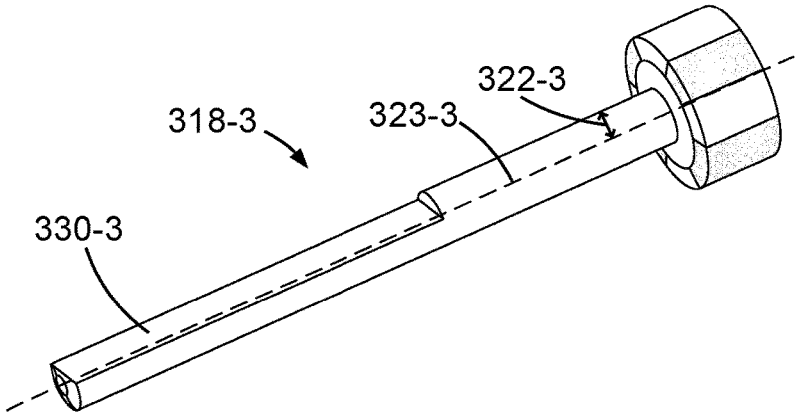

FIG. 2-3 shows an embodiment of a rod 218-3 comprising a noncylindrical external geometry characterized by a radius 222-3, spaced from a central axis 223-3 of the rod 218-3, that varies in magnitude along an axial length of the rod 218-3. While a wide variety of radial variations are anticipated, for simplicity's sake, this embodiment comprises two substantially constant radial sections; a first section 224-3 comprising a relatively smaller radius and a second section 225-3 comprising a relatively larger radius. The present embodiment also comprises a generally sloping transition between these two substantially constant radial sections.

In FIG. 2-1, a linear solenoid 220-1 retains the associated rod 218-1 in a relatively retracted position such that only a first section 224-1 thereof, comprising a relatively smaller radius, may extend into the through hole 216-1 of the piston 210-1. Because only the relatively smaller first section 224-1 may contact the interior of the through hole 216-1, the piston 210-1 may have a relatively longer potential stroke length 219-1 before being restricted by contact with the rod 218-1.

In FIG. 2-2, a linear solenoid 220-2 ejects the associated rod 218-2 axially to a relatively extended position such that a second section 225-2 thereof, comprising a relatively larger radius, may also extend into the through hole 216-1 of the piston 210-1, in addition to a first, relatively smaller, section 224-2. With this relatively larger second section 225-2 also potentially contacting the interior of the through hole 216-2, the piston 210-2 may have a relatively shorter potential stroke length 219-2 due to changed location of contact with the rod 218-2.

FIGS. 3-1 and 3-2 show embodiments of other adjustable rods 318-1, 318-2 that may alter stroke lengths 319-1, 319-2 of associated pistons 310-1, 310-2 by a different mechanism. Such stroke length alterations may still be enabled by rods 318-1, 318-2 comprising noncylindrical external geometries. However, in these embodiments, external geometries of the rods 318-1, 318-2 may vary around a circumference thereof.

For example, FIG. 3-3 shows an embodiment of a rod 318-3 comprising a radius 322-3, spaced from a central axis 323-3 of the rod 318-3, that varies in magnitude around a circumference of the rod 318-3. While a wide variety or radial variations are possible, again for simplicity's sake, the embodiment comprises a flat surface 330-3 running parallel to the central axis 323-3 of the rod 318-3 and perpendicular to a radius of the rod 318-3.

In FIG. 3-1, a rotary solenoid 320-1 positions the associated rod 318-1 rotationally such that a flat surface 330-1 thereof faces a direction 313-1 of travel of the piston 310-1. As this flat surface 330-1 creates a shorter distance from a central axis 323-1 of the rod 318-1 to an external geometry thereof, compared to other portions of the rod 318-1, the piston 310-1 may have a relatively longer potential stroke length 319-1 with the rod 318-1 in this rotational position.

In FIG. 3-2, a rotary solenoid 320-2 may rotate the associated rod 318-2 such that a flat surface 330-2 thereof faces at generally right angles to a direction 313-2 of travel of the piston 310-2. In this position, the stroke length 319-2 may shorten in that the rod 318-2 may restrain translation of the piston 310-2 sooner. While only two positions are shown, generally at right angles from each other about a central axis of a rod, any of a variety of angular positions between these two extremes may provide a partially restricting effect allowing for variable control of a stroke length.

Figure 4:
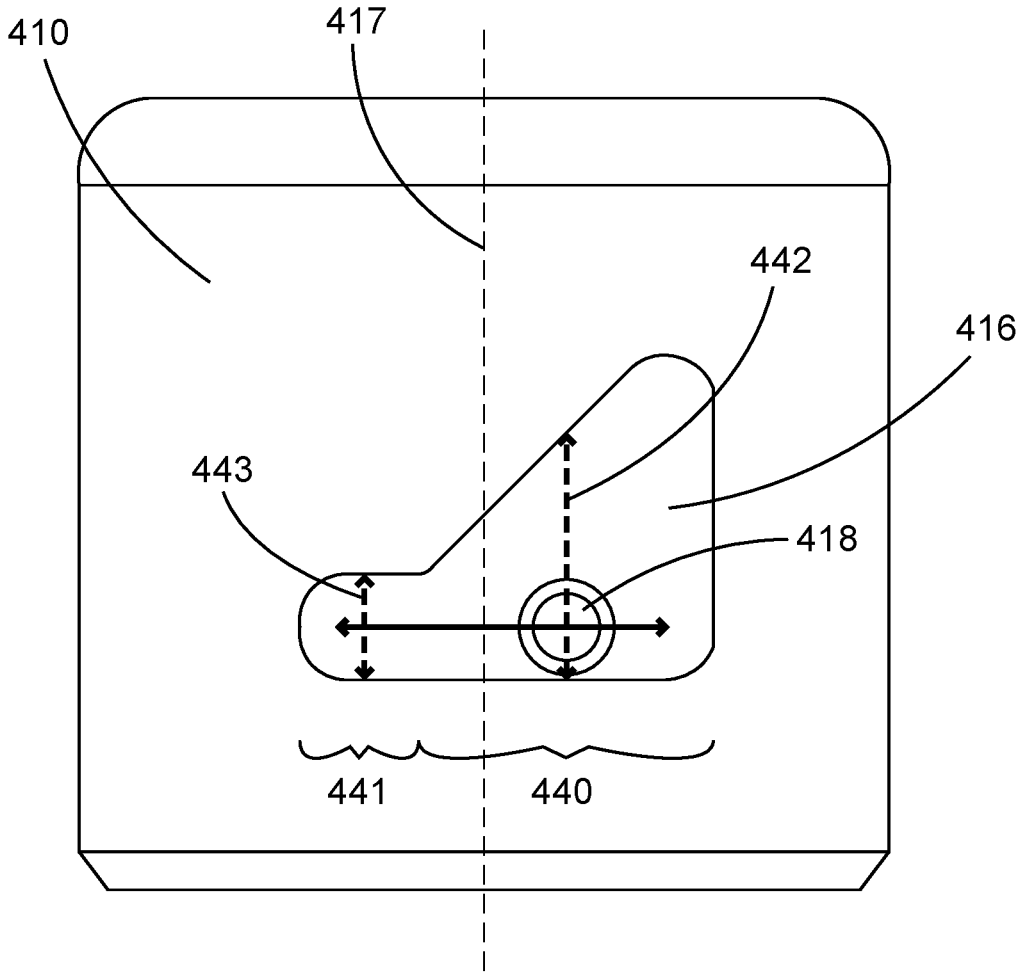
FIG. 4 is an orthogonal view of another embodiment of a piston and rod combination.

The through holes of the embodiments discussed thus far have comprised generally oblong cross-sectional shapes. Other shapes are also anticipated, however. For example, FIG. 4 shows an embodiment of a piston 410 with a through hole 416 passing therethrough. This through hole 416 may comprise a cross-sectional shape featuring a generally triangular section 440 and a notch 441 section. A rod 418 passing through the through hole 416 may restrict translation of the piston 410 when in contact with an interior of the through hole 416. In the embodiment shown, this rod 418 is capable of radial translation, or translation perpendicular to a central axis 417 of the piston 410. Adjustment of the rod 418 in this manner may reposition it with respect to the through hole 416. Specifically, radial translation of the rod 418 within the generally triangular section 440 of the through hole 416 may change an internal width 442, extending in a direction parallel with the central axis 417 of the piston 410, at the location of the rod 418. Changing this through hole 416 width 442 may grant the piston 410 a different stroke length.

Additionally, the notch 441 section of the through hole 416 may comprise an internal width 443 substantially similar to an external dimension of the rod 418 in the same direction. If the rod 418 is translated into the notch 441 section, the stroke length 419 of the piston 410 may be restricted to naught effectively locking the position of the piston 410 in place.

Whereas this discussion has referred to the drawings attached hereto, it should be understood that other and further modifications apart from those shown or suggested herein, may be made within the scope and spirit of the present disclosure.

The invention claimed is:

1. A piston control assembly, comprising:

a piston slidably disposed within a hollow cylinder and comprising a through hole in a first direction across the piston; and a rod passing through the through hole and restricting a stroke of the piston; wherein the rod is adjustable to alter such stroke restriction;

the stroke of the piston is in a second direction; and the first direction is different than the second direction.

2. The piston control assembly of claim 1, wherein the rod comprises a noncylindrical external geometry.

3. The piston control assembly of claim 2, wherein a radius of the external geometry varies along an axial length of the rod.

4. The piston control assembly of claim 3, wherein the external geometry transitions between two constant radial sections along the axial length thereof.

5. The piston control assembly of claim 2, wherein a radius of the external geometry varies around a circumference of the rod.

6. The piston control assembly of claim 5, wherein the external geometry comprises a flat surface running parallel to an axis of the rod.

7. The piston control assembly of claim 6, wherein the flat surface is perpendicular to a radius of the rod.

8. The piston control assembly of claim 1, wherein the rod is adjustable via at least one of radial translation, axial translation and rotation.

9. The piston control assembly of claim 1, wherein the piston stroke is restricted by contact between an external geometry of the rod and an interior wall of the piston through hole.

10. The piston control assembly of claim 9, wherein the piston stroke restriction is altered by changing a distance between a point of contact, between the external geometry of the rod and the interior wall of the piston through hole, and a central axis of the rod.

11. The piston control assembly of claim 1, wherein the rod is adjusted to restrict the piston stroke to naught.

12. The piston control assembly of claim 1, wherein the through hole comprises an oblong shape elongated in a direction parallel with a central axis of the piston.

13. The piston control assembly of claim 1, wherein the through hole comprises a notch with a width, in a direction parallel with a central axis of the piston, similar to a dimension of the rod in the same direction.

14. The piston control assembly of claim 1, wherein the rod is perpendicular with a central axis of the piston.

15. The piston control assembly of claim 1, wherein the rod is attached to the hollow cylinder.

16. The piston control assembly of claim 15, wherein the rod is attached to the hollow cylinder at two opposing ends of the rod.

17. A method for controlling a piston, comprising:

disposing a piston slidably within a hollow cylinder;

passing a rod through a through hole within the piston, wherein the through hole extends in a first direction across the piston;

restricting a stroke of the piston in a second direction with the rod, wherein the first direction is different than the second direction; and adjusting the rod to alter the piston stroke restriction.

18. The method for controlling the piston of claim 17, wherein adjusting the rod comprises at least one of:

translating the rod radially relative to a central axis thereof;

translating the rod axially along the central axis; and rotating the rod around the central axis.

19. The method for controlling the piston of claim 17, wherein restricting the stroke of the piston comprises contacting an interior wall of the piston through hole with an external geometry of the rod; and altering the piston stroke restriction comprises changing a distance between a point of contact, between the external geometry of the rod and the interior wall of the piston through hole, and a central axis of the rod.

20. The method for controlling the piston of claim 17, wherein restricting the stroke of the piston comprises locking the position of the piston.

* * * * *